United States Patent [19]

Thometz

[11] Patent Number: 4,546,922

[45] Date of Patent: Oct. 15, 1985

[54] MULTI-COLORED AIRBRUSH ATTACHMENT SYSTEM HAVING A SPIRAL MIXING CHAMBER AND A WRIST/ARM-MOUNTED PAINT RESERVOIR

[76] Inventor: Steve P. Thometz, 20466 W. Cullen Dr., Topanga Canyon, Calif. 90290

[21] Appl. No.: 508,673

[22] Filed: Jul. 22, 1983

Related U.S. Application Data

[63] Continuation-in-part of Ser. No. 279,944, Jul. 2, 1981, abandoned.

[51] Int. Cl.[4] ..... B05B 7/00

[52] U.S. Cl. ..... 239/304; 239/153; 239/413; 239/432; 239/DIG. 14; 137/625.4; 137/888; 137/897

[58] Field of Search ..... 239/152, 153, 302, 303, 239/304, 305, 310, 335, 375, 413, 414, 415, 432, 529, DIG. 14; 366/177, 336, 339, 605; 137/602, 625.4, 888, 889, 896, 897; 222/134, 144.5, 145, 175; 138/42

[56] References Cited

U.S. PATENT DOCUMENTS

| | | | |
|---|---|---|---|
| 577,497 | 2/1897 | Wallwork et al. | 239/305 |
| 912,106 | 2/1909 | Frazier | 239/305 |
| 1,185,344 | 5/1916 | Philibert | 239/305 |
| 1,373,829 | 4/1921 | Perdue | 239/432 |
| 1,948,401 | 2/1934 | Smith et al. | 137/255 |
| 2,216,509 | 9/1937 | Boyd | 222/135 |
| 2,564,392 | 8/1951 | Burrucker | 239/307 |
| 2,606,069 | 8/1952 | Hutchins et al. | 299/86 |
| 3,084,870 | 4/1963 | Hagadorn | 239/305 |
| 3,084,871 | 4/1963 | Puglis | 239/305 |
| 3,135,467 | 6/1964 | Greenman | 239/304 |
| 3,310,204 | 3/1967 | Zinman et al. | 222/144.5 |
| 3,403,695 | 10/1968 | Hopkins | 137/240 |
| 3,412,939 | 11/1968 | Shaffer | 239/415 |
| 3,572,366 | 3/1971 | Wiggins | 137/240 |
| 3,593,965 | 7/1971 | Morane | 366/336 |
| 3,633,795 | 1/1982 | Brooks | 222/134 |
| 4,163,523 | 8/1979 | Vincent | 222/135 |

OTHER PUBLICATIONS

National Airbrush Institute Quarterly, Feb. 1983, "Magic Brush Color Selector Valve, Designed with the Production Artist in Mind".

Airbrush Digest, p. 10, "Binks Offers Multiple-Color Changer".

*Primary Examiner*—Andres Kashnikow
*Assistant Examiner*—James R. Moon, Jr
*Attorney, Agent, or Firm*—Christensen, O'Connor, Johnson & Kindness

[57] ABSTRACT

An apparatus (unit A) for completely and uniformly mixing different colored paints from a reservoir (unit B) is constructed from upper and lower sections (9) and (11). Different colored paints from reservoir (unit B) are supplied through lines (15) to inlet passageways (29) and (29*c*), which are in fluid flow communication with flow control valves (23) and (23*c*) and with corresponding fluid channels (37) spiraling around a generally frustoconically shaped protrusion (27) extending upwardly from the lower housing section (11). Protrusion (27) snugly engages within a correspondingly shaped cavity (25) formed in upper housing section (9), with the inside surface of the cavity cooperating with channels (37) to form individual passageways that crisscross each other to thoroughly mix the different colored paints carried therein. The passageways terminate at the upper end portion of protrusion (27) to discharge the uniformly mixed-together paint out through an outlet tube (5).

10 Claims, 22 Drawing Figures

A.

Fig. 8.
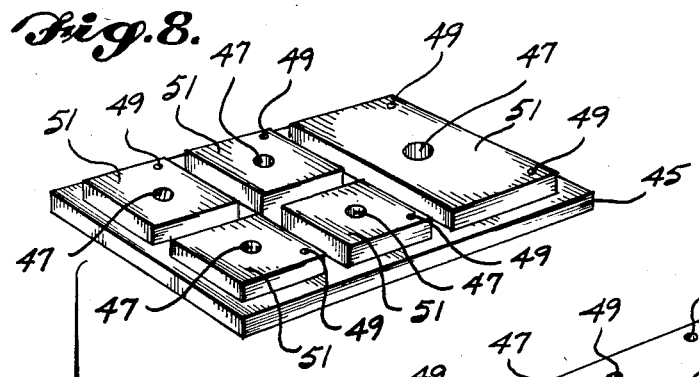
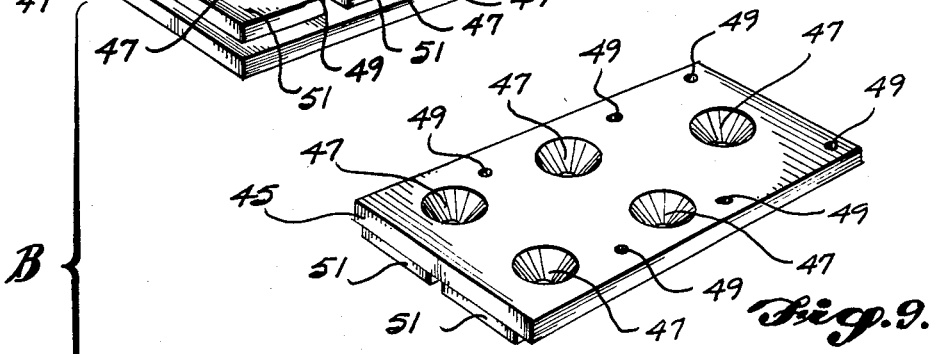
Fig. 9.
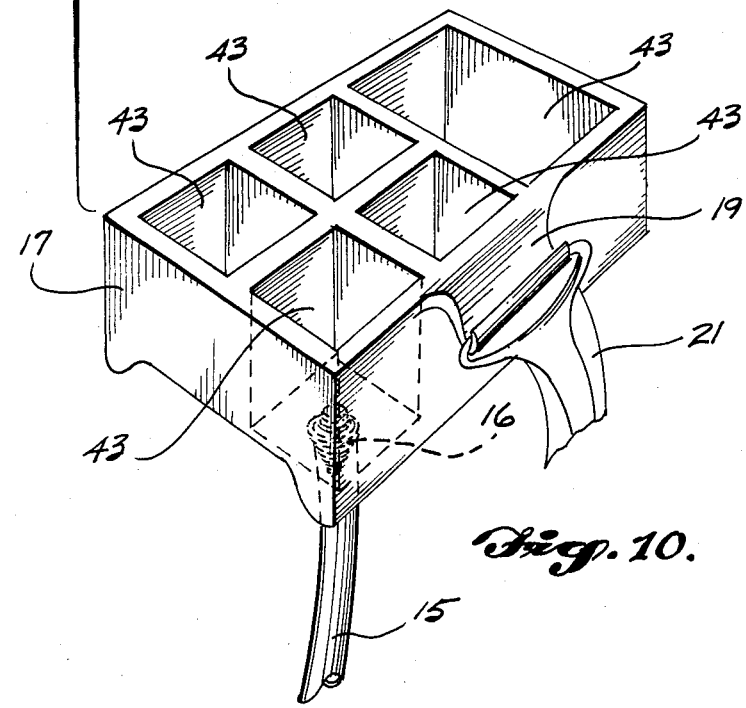
Fig. 10.

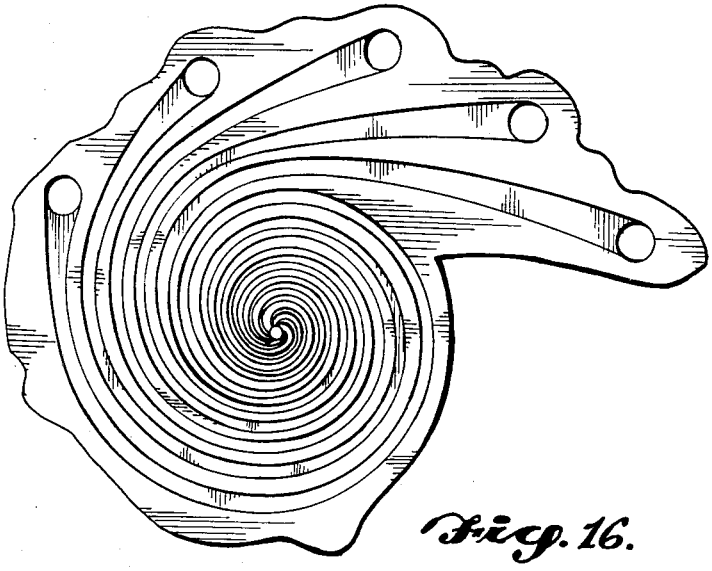
Fig. 16.
Fig. 17.
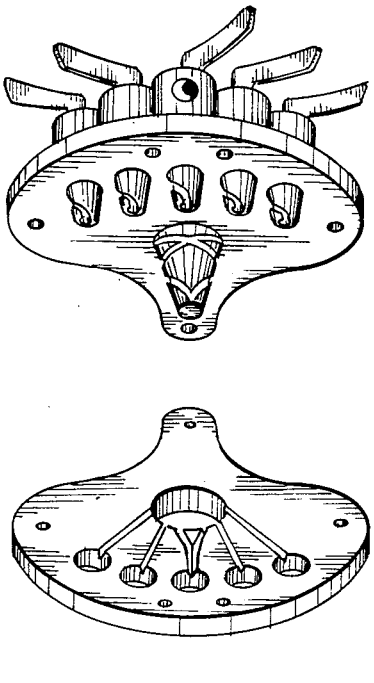

MULTI-COLORED AIRBRUSH ATTACHMENT SYSTEM HAVING A SPIRAL MIXING CHAMBER AND A WRIST/ARM-MOUNTED PAINT RESERVOIR

CROSS-REFERENCE TO RELATED APPLICATION

This application is a continuation-in-part of U.S. application Ser. No. 279,944, filed July 2, 1981, now abandoned, for Multi-Colored Air-Brush Attachment System (acronym MCABAS) Having a Spiral Mixing Chamber and a Wrist/Arm Mounted Paint Reservoir.

TECHNICAL FIELD

The present invention is an improvement in airbrush attachments for producing any color of paint without the need to continually change paints. More specifically, the present invention concerns an attachment system designed with a spiral mixing chamber, a quarter-twist variable control valve system for controlling the flow rates of the different paints entering the mixing chamber from flexible tubing interconnected in fluid flow communication with a comfortable, easy to reach, paint reservoir that is adapted to be worn on the user's arm.

SUMMARY OF THE INVENTION

It is the object of the present invention to provide an inexpensive, economic to manufacture, lightweight, comfortable, easy to use, quick and easy to clean, assemble and disassemble, color change and mixing system for airbrushes. The system also includes a wrist mounted paint reservoir attachment for paint spray devices. Being that no such device is on the market for conventional airbrushes, there exists a need for a small, lightweight and relatively simple system for supplying a desirable color of paint to an airbrush by uniformly mixing particular colors of paints together at selective relative volumes and which system is capable of quickly and efficiently changing the color of the paint by conveniently adjusting the relative flow rates of the paints.

In another aspect of the present invention, basic color paints are routed through spiraling mixing passageways that intersect each other to thoroughly mix together the different color paints in the passageways. The basic paint colors are supplied to the passageways from a dispenser through supply lines. Valves are disposed between the supply lines and the spiraling mixing passageways to modulate the flow of each basic paint color through the passageways, thereby achieving a desired color of paint that is discharged through an outlet that is in fluid flow communication with the spiraling passageways.

In a further aspect of the present invention, the valves comprise a cylindrical cone-shaped head with an inverted L-shaped groove that tapers from a large opening to a small tip providing variable control of the fluid flow. The result is rapid change of fluid flow rate due to the fact that the valve is constructed to vary from a fully closed to a fully open position with a minimal amount of movement of the valve.

According to an additional aspect of the present invention, the valve system, spiral mixing chamber, and wrist/arm-mounted paint reservoir all have been constructed in accordance to tooling specifications applicable to conventional injection molding processes either out of a metal alloy or plastic, thus enabling these components to be inexpensively manufactured.

Further objects and advantages of the present invention will become apparent from consideration of the drawings and ensuing description thereof.

A further aspect of the present invention includes a housing formed with a mixing chamber having a plurality of spiraling passageways each in fluid flow communication with an inlet passageway for reception of a particular fluid, such as a different color of paint. The spiraling passageways converge together to define a single passageway that is in fluid flow communication with an outlet opening formed in the housing.

In another aspect of the present invention, spiraling radially outwardly open grooves are formed on one-half of a double frustoconically shaped insert that is receivable within a correspondingly shaped seat cooperatively formed by two aligned frustoconically shaped cavities defined by two sections of the housing. The seat wall seals off the radially outwardly open grooves of the insert to define the spiraling passageways. Each of the two housing cavities is in fluid flow communication with an outlet opening. After passing through the passageways and being thoroughly mixed together, the paint or other fluid is discharged from the housing through the particular outlet opening corresponding to the housing cavity in which the grooved half of the insert is engaged. The use of two outlet openings enables the present invention to be utilized with a wide variety of airbrushes having top, bottom or side inlet ports.

BRIEF DESCRIPTION OF THE DRAWINGS

The details of typical embodiments of the present invention will be described in connection with the accompanying drawings, in which:

FIG. 8 is a perspective view of the underside of the cover for the wrist/arm-mounted paint reservoir shown in FIG. 10;

FIG. 9 is a top perspective view of the upper side of the cover shown in FIG. 8;

FIG. 10 is a top perspective view of the wrist/arm-mounted paint reservoir;

FIGS. 13, 14, 15, 16 and 17 illustrate various perspective and schematic views of other possible designs of spiral mixing chambers;

DETAILED DESCRIPTION

Figure 1:
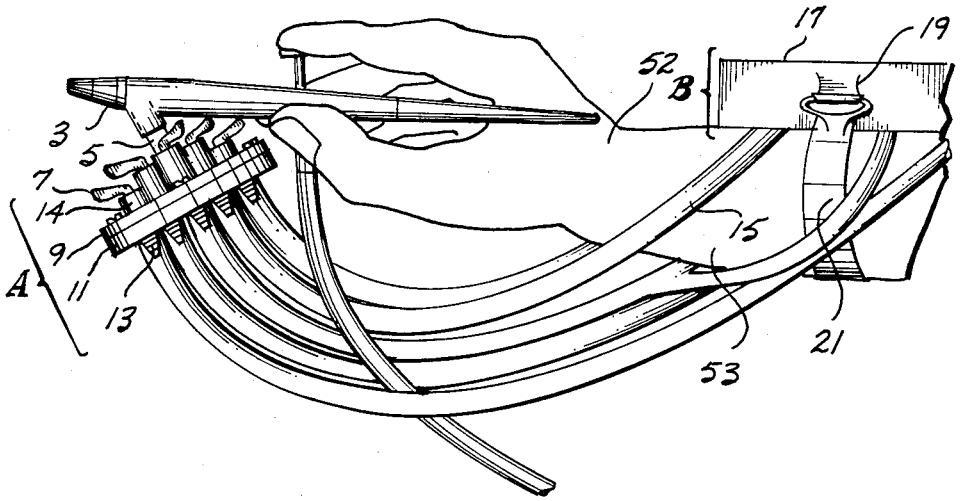
FIG. 1 is a side view illustrating the way the present invention attaches to a conventional airbrush and the position of the paint reservoir on the arm of the operator.

Referring now to the drawings wherein like numbers indicate corresponding parts throughout the several views, the letter (A) indicates the mixing unit of the present invention, which attaches to a conventional airbrush 3, by means of a protruding shaft 5 sized to fit snugly into an inlet orifice of the airbrush. Unit (A) is fed different colors of paint or other fluid by an easy-to-reach wrist/arm-mounted reservoir unit (B), FIGS. 8, 9 and 10, through flexible tubes 15. One end of the tubes 15 engages with nipples 16 extending downwardly from the underside of unit (B), FIG. 10, and the other end of the tubes engage with nipples 13 extending downwardly from the lower section 11 of unit (A). Lower section 11 of unit (A) includes a number of funnel-shaped holes or cavities 29 which are in fluid flow communication with channels 37 formed in lower section 11 and in a frustoconically shaped protrusion 27, FIGS. 2 and 4, extending upwardly from lower section 11. By assembling together the upper and lower sections 9 and 11 of unit (A), a spiral mixing chamber is created which will be discussed in further detail later. The funnel-shaped cavity 25 is formed in the upper section 9 of unit (A) in a shape and size corresponding to the shape and size of protrusion 27, FIG. 4. Cavity 25 is in communication with an outlet opening formed in outlet tube 5.

Figure 2:
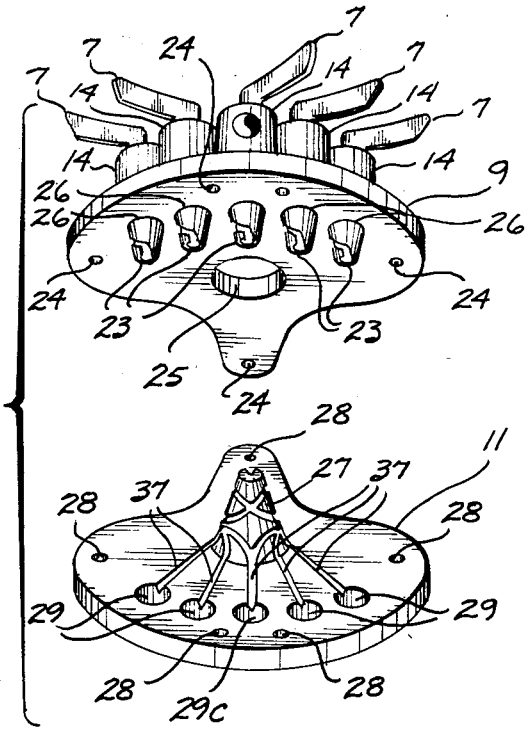
FIG. 2 is a perspective view of the lower and upper sections of the mixing unit, with valves placed in the upper section.
Figure 3:
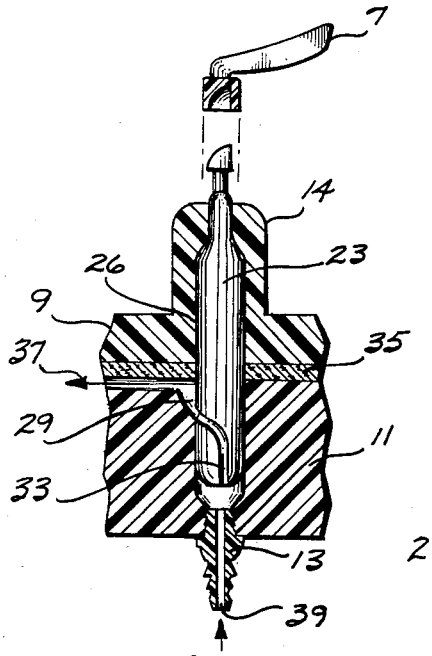
FIG. 3 is a longitudinal sectional view through the two halves of the mixing unit in FIG. 2 with a gasket and showing a valve disposed in fluid flow position.

Referring to FIG. 3, upper section 9 of unit (A) is illustrated as including a cavity 26 shaped to snugly receive the upper half of cylindrically shaped valve 23. A corresponding cavity 29 is formed in lower section 11 of unit (A). The cavities 26 and 29 are constructed to allow rotational movement but not vertical shifting of valve 23 once the valve has been engaged within the cavities 26 and 29, which cavities function as valve seats. A gasket 35 is disposed between the two upper and lower sections 9 and 11 of unit (A), thereby creating a fluid-tight seal therebetween when the two sections are assembled together by screws, FIG. 1, that extend through clearance holes 24 and 28, FIG. 2, and engage with a standard nut, not shown.

Figure 6:
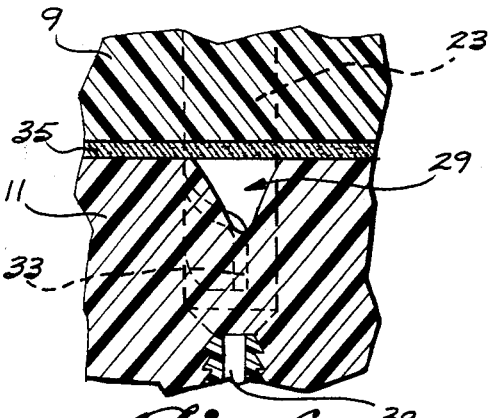
FIG. 6 is an enlarged, fragmentary sectional view demonstrating the valve system when it is completely open.
Figure 7:
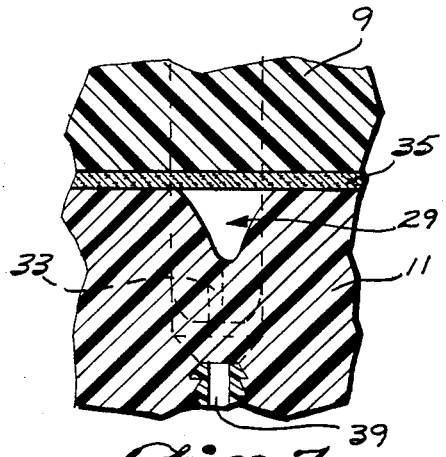
FIG. 7 is a view similar to FIG. 6 showing the valve system closed.

As illustrated in FIG. 3, lower cavities or valve seats 29 and fluid channels 37 are formed in lower section 11 of unit (A). Cavity 29 is sized to snugly receive the lower half of valve 23 and is in communication with a corresponding channel 37 when the opening or notch 33 of valve 23 is aligned with channel 37, FIGS. 3 and 4. FIGS. 3, 6 and 7 show valve notch 33 in detail. FIG. 3 shows valve 23 partially opened, FIG. 6 shows valve 23 in an open position and FIG. 7 shows valve 23 in an off or closed position. As shown in FIG. 6, valve notch 33 is shaped somewhat like an inverted L which tapers from a larger width at the elbow of the L to a smaller tip at the upper end of the L, thus permitting less fluid flow as the tip of channel 23 is rotated closer to channel 37 and the elbow rotated away from the channel. Valve 23 is constructed in such a manner that the upper portion of the valve extends upwardly of cavity 26, FIGS. 1, 2 and 3, to be connected to a lever 7 by any conventional means.

Figure 4:
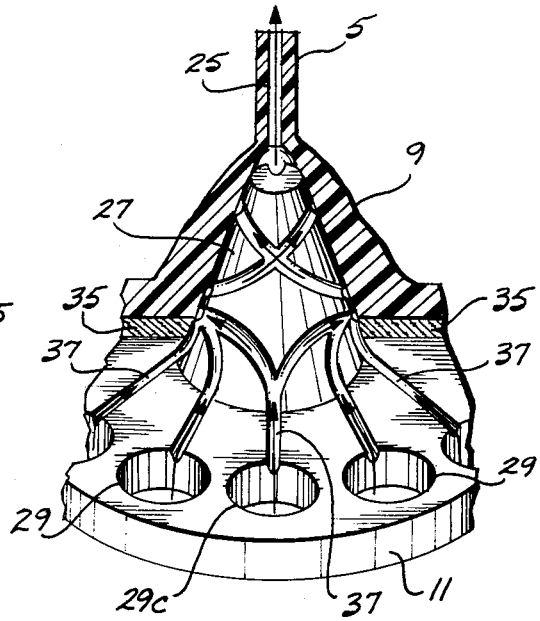
FIG. 4 is an enlarged, fragmentary section view of the mixing chamber and fluid channels.
Figure 5:
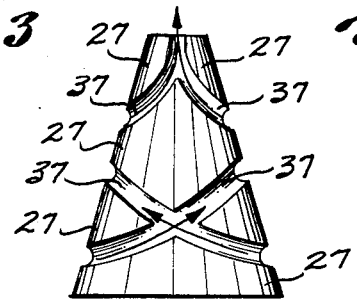
FIG. 5 is a fragmentary, rear view of the protrusion portion of the mixing chamber shown in FIG. 4.

Referring now to FIGS. 4, 5, 11 and 12 there is shown in detail a protrusion 27 snugly engaged with cavity or seat 25 formed in upper section 9 of unit (A). As is illustrated, protrusion 27 is formed as an integral part of lower section 11 of unit (A). The means by which the paint or fluid is mixed is through a process of intertwining spiraling grooves formed in the outer surface of protrusion 27, so that when the upper and lower sections of unit (A) are assembled together, the close fit between protrusion 27 and cavity 25 causes the walls of the cavity to close off the outwardly open portion of the spiraling grooves to define spiraling channels 37. Thus, when fluid is introduced into two or more of such channels, mixing of the fluid occurs as the intertwining channels cross each other's path. The number of times the spiraling channels cross each other may be varied in different specific embodiments of the present invention depending upon various factors, such as the number of different channels formed in protrusion 27, the size of the protrusion and the viscosity of the fluids being mixed together. The pattern of channels 37 is shown schematically in FIG. 11. The spiraling portions of channels 37, as shown in FIG. 4, are in communication with outlet tubes which may be attached directly to a conventional airbrush, FIG. 1.

Now referring specifically to FIGS. 8, 9 and 10, a wrist/arm-mounted paint reservoir, unit (B), is shown in detail. This unit is comprised of five or more separate compartments 43 that contain different fluids or paints. Nipples 16 extend downwardly from the underside of each compartment to engage with flexible outlet or delivery tubes 15. The reservoir is covered by a lid 45, which is constructed in such a manner that each compartment 43 will be closed so as to prevent spillage by means of protruding bosses 51 shaped to conform to the shape of the opening of compartments 43. Funnel-shaped, cylindrical holes 47 are formed in lid 45 for the purpose of allowing the operator to conveniently supply fluid into any individual compartment 43 without the need to remove lid 45. Holes may be closed by means of a plug, not shown, shaped and sized to snugly engage with holes 47. Extending through each of the protruding bosses 51 is a vent 49 that is in communication with a compartment 43 to thus permit air to enter the compartment to prevent creation of a vacuum therein as paint is drawn therefrom.

The wrist/arm-mounted paint reservoir, unit (B), is secured to the operator's wrist 52 and arm 53 by means of strap 21, which is secured at one end to one side of unit (B) and which includes a catch at its other end that may be engaged and detached from a hook 19. Reservoir unit (B), as seen in FIG. 10, conforms to the basic shape of an arm for a comfortable fit. The reservoir can be placed elsewhere on the body, but the preferred location is believed to be the best and most convenient.

As shown in FIGS. 1, 2 and 3, in the upper section 9 of unit (A), valves 23 are at different elevations relative to each other to avoid interference between adjusting levers 37 and to enable the levers to be conveniently manipulated. When the operator wishes to change or mix colors, the tiered effect of valve 23 allows space and room for comfortable, easy reach to selectively rotate the valve levers 7. Furthermore, when two or more levers 7 are being manipulated, there is plenty of room for different positions and for adjusting the valves for precise fluid flow.

To operate the present invention, one needs simply to secure the assembled unit (A) to a conventional airbrush 3 through means as described previously, place the arm/wrist paint reservoir, unit (B), on the arm and attach flexible tubes 15 to units (A) and (B). With lid 45 in place, individual colors such as blue, yellow, red, white and cleaning fluid, water or solvent are placed into compartments and then levers 7 of valves 23 are rotated into appropriate position to obtain any desired single color or any tint, value or dilution within the full spectrum available. Due to the small size of channels 37, the operator can go directly from one color to another with minimal color pollution.

Figure 11:
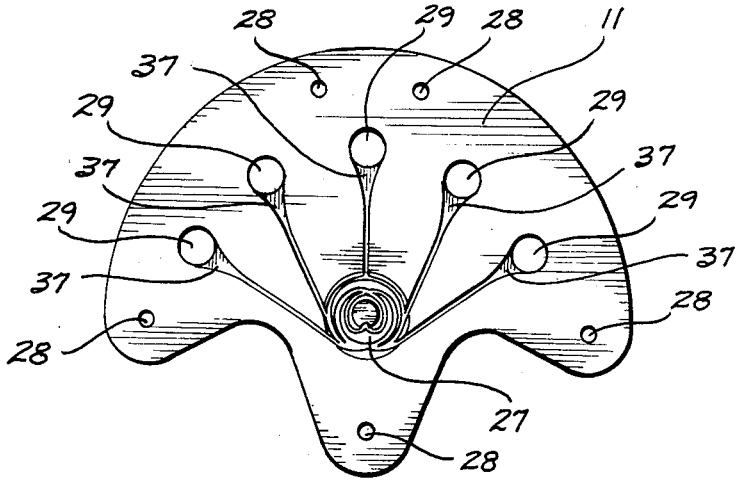
FIG. 11 is a schematic view of the lower section of the mixing unit shown in FIG. 2 showing the configuration of the spiral mixing channels or passageways.
Figure 12:
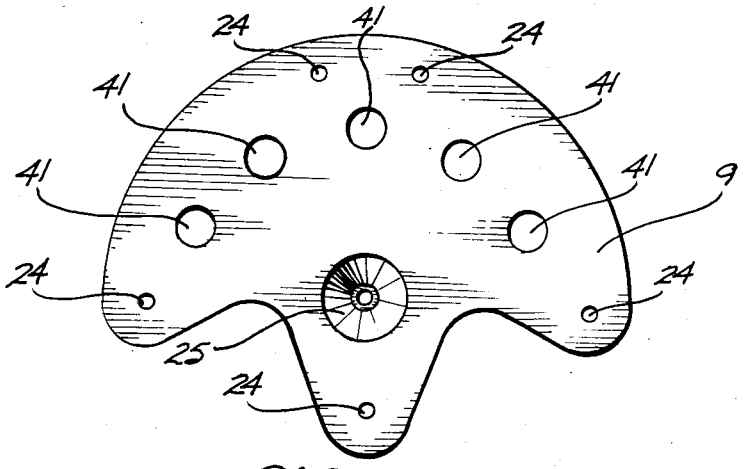
FIG. 12 is a schematic view of the top section of the mixing unit shown in FIG. 2.
Figure 13:
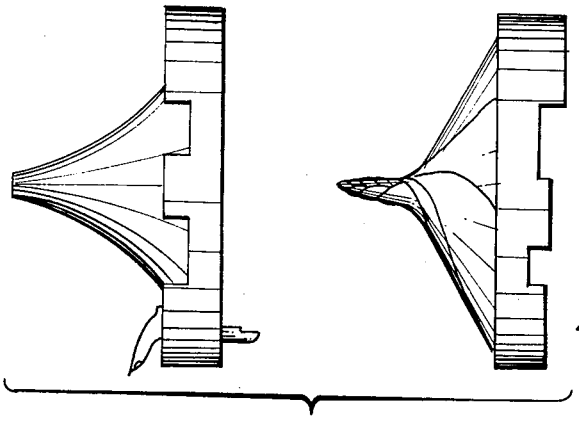
Figure 14:
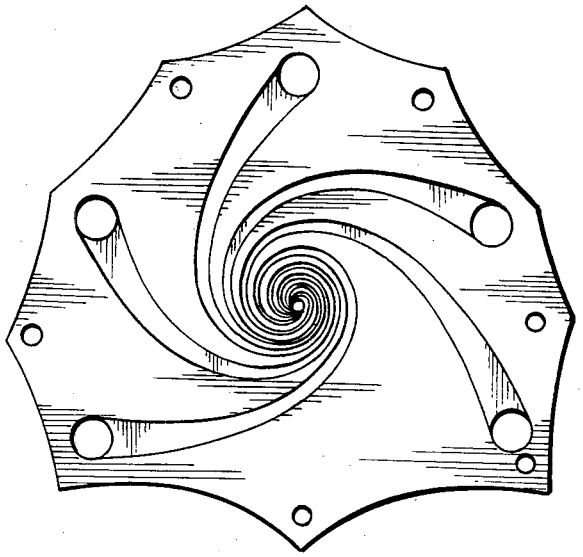
Figure 15:
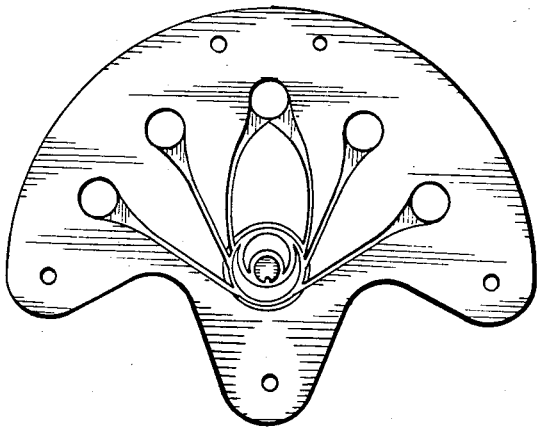

If the operator desires to completely purge the system of debris, all that is needed is to run solvent through the mixing chamber by means of a center valve 23*c*, FIG. 2, engaged within a lower center cavity 29*c* of lower section 11 and an upper center cavity 26*c* of upper section 9 of unit (A). Valve 23*c* is in fluid flow communication with an associated mixing channel 37*c* that intertwines and crosses each of the other channels 37, as shown in FIGS. 2, 4 and 11. Thus, when solvent is introduced through valve 23*c*, the solvent flushes each of the channels 37. When the job is completed and cleaning of the entire system is desired, all the operator needs to do is disassociate flexible tubes 15 from nipples 13 of unit (A) and then flush units (A) and (B) with solvent or water. Thus is created an easy to manufacture, use and clean color mixing attachment system. If the system is not properly cleaned or left without cleaning for a long period of time, which may create obstructions in flow channels, the preferred embodiment is designed to be easily taken apart and thoroughly cleaned with a toothbrush, or similar apparatus, pipe cleaner and solvent or water.

While the above description contains many specificities, these should not be construed as limitations on the scope of the invention, but rather as an exemplification of one preferred embodiment thereof. Several other variations are possible. For example, FIGS. 13, 14, 15, 16 and 17 illustrate several other spiral channel designs and assemblies that are within the scope of the present invention.

FIGS. 18–22 illustrate an apparatus 100 constituting an additional typical embodiment of the present invention. In basic form, apparatus 100 includes a housing 102 composed of an upper section 104 and a lower section 106. Housing lower section 106 includes a plurality of inlet nipples 108*a*, 108*b*, 108*c*, 108*d* and 108*e* interconnected with a plurality of inlet passageways 110*a*, 110*b*, 110*c*, 110*d* and 110*e* through the intermediacy of flow control valves 112*a*, 112*b*, 112*c*, 112*d* and 112*e*, respectively. Passageways 110*a*–110*e* are disposed in fluid flow communication with individual spiraling passageways 114*a*, 114*b*, 114*c*, 114*d* and 114*e*, respectively, of a mixing chamber 116 cooperatively defined by double-frustoconically shaped insert 118 that is snugly receivable within a correspondingly shaped seat 120 formed by portions of housing upper and lower sections 104 and 106. Spiraling passageways 114*a*–114*e* converge into a single passageway 122 that is in fluid flow communication with either an upper outlet tube 124 or a lower outlet tube 126 depending upon the orientation of insert 118 within seat 120, FIGS. 21 and 22.

Figure 18:
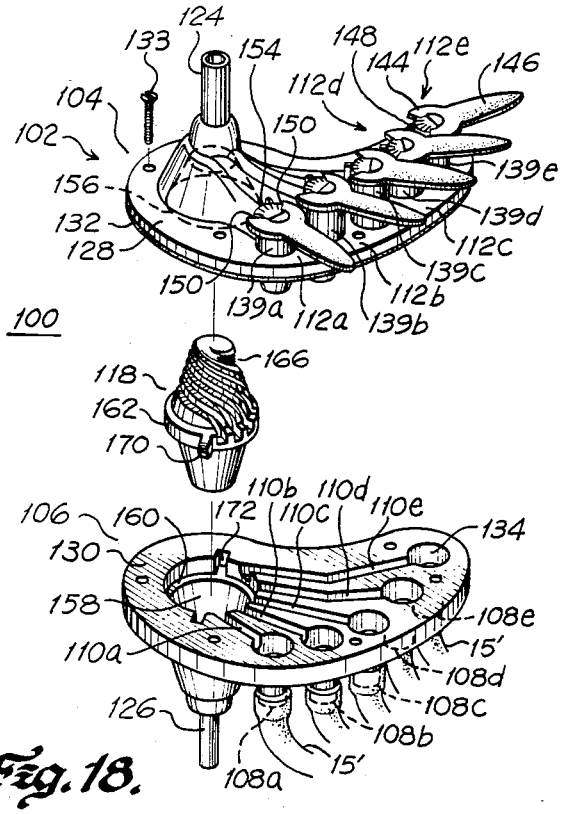
FIG. 18 is an exploded, isometric view of another typical embodiment of the present invention.
Figure 21:
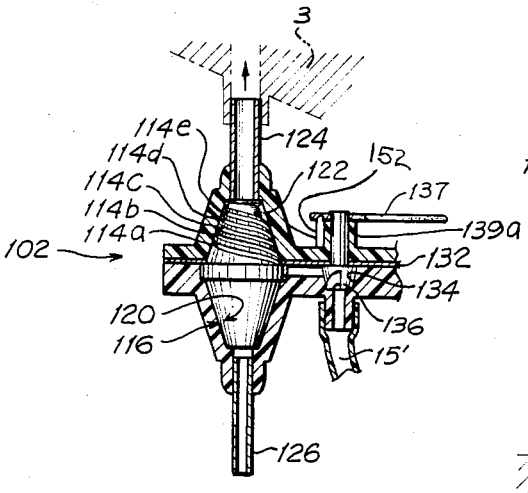
FIG. 21 is a fragmentary, cross-sectional view of the embodiment of the present invention shown in FIG. 18 specifically illustrating the spiraling mixing passageways in communication with an upwardly extending outlet opening.
Figure 22:
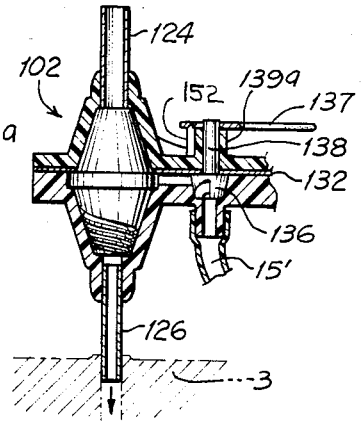
FIG. 22 is a fragmentary, cross-sectional view of the embodiment of the present invention shown in FIG. 19 specifically illustrating the spiraling mixing passageways in communication with a downwardly extending outlet opening.

Next describing apparatus 100 in greater detail, as shown in FIGS. 18, 21 and 22, housing upper and lower sections 104 and 106 are formed similarly to each other in a generally crescent shape. The upper and lower housing sections correspond generally to sections 9 and 11 of unit (A), FIGS. 1–6, 11 and 12. Housing sections 104 and 106 are formed with generally planar flange portions 128 and 130 having flat mating surfaces which are sealed with a gasket when the two sections are assembled together by a plurality of fasteners in the form of screws 133 that extend through aligned clearance holes formed in flange portions 128 and 130 to threadably engage with a standard nut, not shown.

A plurality of cylindrical nipples 108*a*–108*e* depend downwardly from flange portion 130 of housing lower section 106 to engage within the adjacent end portions of flexible lines 15'. The opposite ends of the lines may be engaged with orifices 16, depending downwardly from the under side of paint reservoir, unit (B), shown in FIG. 10, in a manner similar to lines 15'. Ideally, lines 15' are constructed from flexible, transparent or translucent material to enable the operator to confirm that paints or other fluids are flowing through the lines and also the color of the paints or fluids.

Nipples 108*a*–108*e* are spaced apart along the larger or outer margin of the flange portion 130 of lower housing section 106 and are aligned in fluid flow communication with seats 134 of valves 112*a*–112*e*. Each seat 134 is formed in the shape of a downwardly tapered blind bore for snugly receiving a correspondingly shaped head portion 136 of valves 112*a*–112*e*. Each valve also includes an elongate shaft 138 extending upwardly from head portion 136 through a close fitting bore formed in a corresponding circular boss 139*a*, 139*b*, 139*c*, 139*d* and 139*e*, each extending upwardly from the flange portion 128 of housing upper section 104 in alignment with a seat 134. The upper ends of shafts 138 extend above bosses 139*a*–139*e* to engage with actuating lever 137 that are manually operable to rotate valves 112*a*–112*e*.

Figure 19:
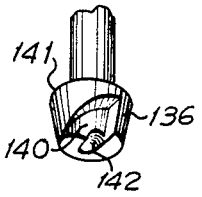
FIG. 19 is an enlarged fragmentary isometric view of a valve employed in the embodiment of the present invention shown in FIG. 18.
Figure 20:
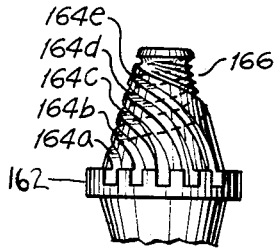
FIG. 20 is an enlarged, fragmentary isometric view of the spiraling mixing passageways formed in a double frustoconically shaped insert employed in the embodiment of the present invention shown in FIG. 18.

Describing valves 112*a*–112*e* in greater detail, the head portion 136 of each valve is held captive within a corresponding seat 134 by the lower surface of flange portion 128 of the upper housing section 104 bearing downwardly against the enlarged, flat upper surface 141 of the head portion through the intermediacy of gasket 132. As shown in FIG. 19, a generally triangularly shaped notch 140 is formed along a portion of the circumference of each valve head portion 136. Also, as most clearly shown in FIG. 19, a trough or notch 142 extends diametrically along the bottom of valve head portion 136 to intersect with triangular notch 140 to direct fluid from nipples 108*a*–108*e* into notch 140. To meter the flow of fluid through valves 110*a*–110*e*, levers 137 may be operated to rotate valve head portions 136 between a fully closed position, as shown in FIG. 21, wherein triangular notch 140 is disposed out of registry with inlet passageways 110*a*–110*e* and an open position, not shown, wherein triangular notch 140 is in variable registry with inlet passageways, with the maximum open position occurring when a portion of triangular notch 140, having the greatest height, is in registry with the inlet passageways. To close valves 112*a*–112*e*, levers 137 may by rotated in reverse direction so that an unnotched portion of valve head 136 is again in registry with inlet passageways 110*a*–110*e*.

As shown in FIG. 18, the heights of valve shafts 138 and bosses 139*a*–139*e* are varied so that actuating levers 137 are in different elevations to prevent the levers from interfering with each other as they are rotated. The actuating levers 137 are generally planar and composed of an arcuate head portion 144 and an elongate arm portion 146 extending radially outwardly from the head portion far enough to be easily manipulated by the fingers of the user but not so far so as to unnecessarily increase the overall size of apparatus 100. Lever head portion 144 includes a central, semicircularly shaped opening for snugly receiving the correspondingly shaped upper end portion of valve shaft 138. Lever head portion 144 also includes a reduced diameter segment 148 formed in the sector of the head portion diametrically opposite arm portion 146 to define end walls 150 extending radially outwardly from each end of the reduced diameter segment, FIG. 18. A narrow flange 152 extends radially outwardly from each boss 139*a*–139*e*, with the upper portion of the flange abutting against end walls 150 when valves 112*a*–112*e* are rotated to their extreme open and closed positions, thereby limiting the rotational movement of the valves. Also, a plurality of radially extending ridges or indicia are spaced apart along reduced diameter segment 148 of lever head portion 144 to indicate the extent to which valves 112*a*–112*e* are open or closed by the relationship of the indicia relative to the upper end portion of flange 152.

Apparatus 110 also includes a fluid mixing chamber 116 composed of an upper, generally frustoconically shaped cavity 156 formed within housing upper section 104, and a lower, generally fructoconically shaped cavity 158 formed within lower housing section 106. The housing upper and lower sections are domed to accommodate the upper and lower cavities 156 and 158. Upper cavity 156 is in fluid flow communication with an outlet tube 124 pressed into close fitting bore formed at the upper, tapered end of the cavity, and the lower cavity 158 is in fluid flow communication with an outlet tube 126 also pressed within a close fitting bore formed in the lower, tapered end of the lower cavity. The two upper and lower cavities 156 and 158 are similar in size and shape with the exception that a shallow, circular counterbore 160 is formed in the upper portion of lower cavity 158. Ideally, the counterbore is disposed at the vertical center of the double frustoconically shaped seat 120 cooperatively defined by the upper and lower cavities. Also, inlet passageways 110*a*–110*e* intersect counterbore 160 at locations equally spaced apart along the adjacent diametrical half of the counterbore.

As most clearly shown in FIGS. 21 and 22, the double frustoconically shaped seat 120 formed by cavities 156 and 158 is sized to snugly receive a correspondingly shaped insert 118 having a central ridge portion 162 that divides the insert into opposite halves. Ridge portion 162 is closely receivable within counterbore 160. Preferably, the halves of the insert on opposite sides of ridge portion 162 are substantially identical in size and shape, with the exception that the outer surface of one half is smooth, while a plurality of spiraling grooves 164*a*, 164*b*, 164*d* and 164*e* are formed in the outer surface of the opposite half of the insert. Each groove 164*a*–164*e* originates at spaced-apart locations along ridge portion 162 and then spirals away from the ridge portion in converging relationship to the other grooves so that the grooves eventually intersect together to form a single groove 166 that terminates at the distal or end of the insert.

When insert 118 is engaged within seat 120, as shown in FIGS. 21 and 22, the seat wall closes off grooves 164*a*–164*e* to cooperatively form individual spiraling passageways 114*a*–114*e*, which passageways converge together to form a single passageway 122 corresponding to singular groove 166. Lugs 170 extend diametrically outwardly from ridge portion 162 of insert 118 to engage within corresponding notches 172 extending radially outwardly from counterbore 160 to properly orient the insert so that grooves 164*a*–164*e* at ridge portion 162 are in registry with corresponding inlet passgeways 110*a*–110*e* at counterbore 160 to receive fluid therefrom and then discharge the fluid in completely and uniformly mixed condition out through one of the outlet tubes 124 or 126. It will be appreciated that the orientation of insert 118 within seat 120 dictates through which outlet tube the uniformly mixed fluid is discharged, FIGS. 21 and 22. Ideally, grooves 164*a*–164*e* are uniformly spaced apart one semicircular half of ridge portion 162, and inlet passageways 110*a*–110*e* are correspondingly uniformly spaced apart along one of the semicircular halves of counterbore 160 extending between notches 172 so that the grooves are in registry with correspondingly inlet passageways when insert 118 is oriented, as shown in FIG. 21, to discharge fluid through upper outlet tube 124 and also when the direction of the insert is reversed into the orientation shown in FIG. 22 to discharge fluid downwardly through lower outlet tube 126.

It will be appreciated that by the above construction, the individual fluids, such as different colored paints, are thoroughly mixed together within mixing chamber 116 prior to being discharged out of either outlet tube 124 or outlet tube 126. By directing the paint flowing through spiraling passageways 114*a*–114*e* that converge together, sufficient turbulence is generated in the different paints to cause the paints to thoroughly mix together within passageway 122. It will also be appreciated that the compact construction of the present invention, with relatively short inlet passageways 110*a*–110*e* and relatively short spiraling passageways 114*a*–114*e*, enable the color of the paint discharged from outlet tubes 124 and 126 to be quickly changed by adjusting valves 112*a*–112*e*. In addition, constructing apparatus 100 with both an upper outlet tube 124 and a lower outlet tube 126 enables the apparatus to be conveniently utilized in conjunction with virtually all types of commonly used airbrushes, whether the airbrush has a side inlet, a bottom inlet or a top inlet.

To utilize the present invention, a decision is initially made as to which outlet tube, 124 or 126, is to be employed, and then insert 118 is placed within seat 120 in the corresponding direction. Thereafter, housing upper and lower sections 104 and 106 are assembled together with a gasket 132 therebetween by screws 124. Next, inlet lines 15' are attached to nipples 108*a*–108*e* and the selected outlet tube 124 or 126 is engaged with the inlet 3 or 3' of an airbrush. Lastly, the flow of fluid through apparatus 10 is conveniently metered by adjustment of valves 112*a*–112*e*.

As will be apparent to those skilled in the art to which the invention is addressed, the present invention may be embodied in forms other than those specifically disclosed above without departing from the spirit or scope or essential characteristics of the invention. The particular embodiments of the multi-colored airbrush attachment systems, described above, are therefore to be considered in all respects as illustrative and not restrictive. The scope of the present invention is as set forth in the appended claims rather than being limited to the examples of the attachment systems set forth in the foregoing description.

The embodiments of the invention in which an exclusive property or privilege is claimed are defined as follows:

1. A compact, lightweight apparatus for selectively supplying multi-colored paints to an airbrush having a paint inlet port, said apparatus comprising:
- a housing having an outlet opening;
- a plurality of individual inlet passageways, each connectable to a separate fluid supply;
- selectively adjustable valve means disposed in fluid flow communication with each of said inlet passageways to meter the volume of fluid flowing therethrough; and,
- mixing chamber means for thoroughly mixing the different fluids flowing through the inlet passageways and directing said mixture to the housing outlet opening, said mixing chamber means comprising a plurality of spiral mixing passageways each interconnecting in fluid flow communication a corresponding inlet passageway with the outlet opening, said spiral mixing passageways initially disposed in generally parallel relationship to each other and then converging with each other to form a single common passageway in communication with the outlet opening to cause the fluids carried therein to thoroughly mix with each other prior to reaching the outlet opening.

2. A compact, lightweight apparatus for selectively supplying multi-colored paints to an airbrush having a paint inlet port, said apparatus comprising:
- a housing being composed of two mating sections having an outlet opening;
- a plurality of individual inlet passageways, each connectable to a separate fluid supply;
- selectively adjustable valve means disposed in fluid flow communication with each of said inlet passageways to meter the volume of fluid flowing therethrough;
- mixing chamber means for thoroughly mixing the different fluids flowing through the inlet passageways and directing said mixting to the housing outlet opening, said mixing chamber means comprising a plurality of spiral mixing passageways each interconnecting in fluid flow communication a corresponding inlet passageways with the outlet opening, said mixing passageways disposed in spiraling relationship to each other and in communication with each other to cause the fluids carried therein to thoroughly mix with each other prior to reaching the outlet opening; and,
- wherein said mixing chamber means further comprises:
  - a frustoconically shaped protrusion being associated with one of said housing sections, said protrusion having a plurality of spiraling channels formed on the exterior surface thereof, said channels being in communication with each other, and,
  - said other housing section having portions defining a frustoconically shaped seat in communication with said outlet opening, said seat snugly receiving said frustoconically shaped protrusion to cooperatively form said spiraling passageways by the intersection of said channels with the surface of said seat.

3. The apparatus according to claim 2, wherein said spiraling mixing passageways cross each other.

4. The apparatus according to claim 2, wherein said spiraling mixing passageways converge together to form a singular passageway in communication with the outlet opening of said housing.

5. A compact, lightweight apparatus for selectively supplying multi-colored paints to an airbrush having a paint inlet port, said apparatus comprising:
- a housing having an outlet opening;
- a plurality of individual inlet passageways, each connectable to a separate fluid supply;
- selectively adjustable valve means disposed in fluid flow communication with each of said inlet passageways to meter the volume of fluid flowing therethrough;
- mixing chamber means for thoroughly mixing the different fluids flowing through the inlet passageways and directing said mixture to the housing outlet opening, said mixing chamber means comprising a plurality of spiral mixing passageways each interconnecting in fluid flow communication a corresponding inlet passageways with the outlet opening, said mixing passageways disposed in spiraling relationship to each other and in communication with each other to cuase the fluids carried therein to thoroughly mix with each other prior to reaching the outlet opening;
- wherein said housing is composed of two mating sections, each of said sections:
  - defining an outlet opening; and,
  - defining a similarly shaped cavity in communication with an associated outlet opening, said cavities and said two housing sections disposed in registry with each other when said two housing sections are assembled together to cooperatively define a double-frustoconically shaped seat; and,
- wherein said mixing chamber means including a removable insert in the shape of a double frustocone, said insert:
  - shaped and sized to be snugly receivable within the seat defined by the two cavities of said housing sections; and,
  - having a plurality of spiraling channels formed on the exterior one frustoconical portion of said insert and cooperating with the surface of said seat to define said spiraling passageways to interconnect in fluid flow communication said inlet passageways with a selective outlet opening in response to the orientation of said insert within said seat.

6. The apparatus according to claim 5, wherein said spiraling mixing passageways diagonally intersect each other.

7. The apparatus according to claim 5, wherein said spiraling mixing passageways converge together to form a singular passageway in communication with the selective outlet opening.

8. A compact, lightweight apparatus for selectively supplying multi-colored paints to an airbrush having a paint inlet port, said apparatus comprising:

a housing having an outlet opening;

a plurality of individual inlet passageways, each connectable to a separate fluid supply;

selectively adjustable valve means disposed in fluid flow communication with each of said inlet passageways to meter the volume of fluid flowing therethrough;

mixing chamber means for thoroughly mixing the different fluids flowing through the inlet passageways and directing said mixture to the housing outlet opening, said mixing chamber means comprising a plurality of spiral mixing passageways each interconnecting in fluid flow communication a corresponding inlet passageway with the outlet opening, said mixing passageways disposed in spiraling relationship to each other and in communication with each other to cause the fluids carried therein to thoroughly mix with each other prior to reaching the outlet opening; and, further comprising a fluid reservoir mounted on the wrist 52 of the user, including:

a plurality of individual fluid receiving and storing compartments;

a plurality of flexible fluid transfer lines interconnecting said compartments with said housing inlet passageways; and, means for mounting said reservoirs on the wrist 52 of the user.

9. The apparatus according to claim 8, wherein said fluid transfer lines are connected of transparent or translucent material.

10. The apparatus according to claim 8, wherein said reservoir mounting means includes a saddle contoured to receive the wrist 52 or the arm of the user.

* * * * *